US010712684B2

(12) United States Patent
Wakabayashi et al.

(10) Patent No.: US 10,712,684 B2
(45) Date of Patent: Jul. 14, 2020

(54) DEVELOPING ROLLER, ELECTROPHOTOGRAPHIC PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Kazuhito Wakabayashi, Susono (JP); Kazuaki Nagaoka, Susono (JP); Ryo Sugiyama, Mishima (JP); Kunimasa Kawamura, Mishima (JP); Minoru Nakamura, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/541,732

(22) Filed: Aug. 15, 2019

(65) Prior Publication Data

US 2020/0073279 A1 Mar. 5, 2020

(30) Foreign Application Priority Data

Aug. 31, 2018 (JP) ..... 2018-162332

(51) Int. Cl.
*G03G 15/08* (2006.01)
*G03G 21/18* (2006.01)

(52) U.S. Cl.
CPC ..... *G03G 15/0808* (2013.01); *G03G 21/1814* (2013.01)

(58) Field of Classification Search
CPC ..... G03G 15/0808; G03G 2215/0858; G03G 2215/0861
See application file for complete search history.

(56) References Cited

U.S. PATENT DOCUMENTS

| | | | |
|---|---|---|---|
| 6,636,715 | B2 | 10/2003 | Kawamura et al. |
| 7,060,406 | B2 | 6/2006 | Kawamura et al. |
| 7,727,134 | B2 | 6/2010 | Nakamura et al. |
| 7,797,833 | B2 | 9/2010 | Nakamura et al. |
| 7,798,948 | B2 | 9/2010 | Kawamura et al. |
| 7,799,398 | B2 | 9/2010 | Nakamura et al. |
| 8,059,997 | B2 | 11/2011 | Otake et al. |

(Continued)

FOREIGN PATENT DOCUMENTS

| | | |
|---|---|---|
| CN | 101002147 | 7/2007 |
| JP | S62-55147 | 3/1987 |

(Continued)

OTHER PUBLICATIONS

U.S. Appl. No. 16/516,790, Kazutoshi Ishida, filed Jul. 19, 2019.

(Continued)

*Primary Examiner* — Thomas S Giampaolo, II
(74) *Attorney, Agent, or Firm* — Venable LLP

(57) ABSTRACT

To provide a developing roller having improved toner conveying force in a high-temperature and high-humidity environment. The developing roller has a substrate and an electro-conductive layer on the substrate. The outer surface of the developing roller has an electrical insulating first region and an electro-conductive second region adjacent to the first region and at the same time has at least one groove in the first region.

15 Claims, 6 Drawing Sheets

(56) References Cited

U.S. PATENT DOCUMENTS

| | | | | |
|---|---|---|---|---|
| 8,372,570 | B2 | 2/2013 | Matsuda et al. | |
| 8,377,549 | B2 | 2/2013 | Takayama et al. | |
| 8,529,806 | B2 | 9/2013 | Kawamura et al. | |
| 8,546,051 | B2 | 10/2013 | Otake et al. | |
| 8,600,273 | B2 | 12/2013 | Yamada et al. | |
| 8,628,846 | B2 | 1/2014 | Wakabayashi et al. | |
| 8,655,222 | B2 | 2/2014 | Nakamura et al. | |
| 8,655,238 | B2 | 2/2014 | Uno et al. | |
| 8,745,870 | B2 | 6/2014 | Kawamura et al. | |
| 8,768,226 | B2 | 7/2014 | Koyanagi et al. | |
| 8,768,227 | B2 | 7/2014 | Urushihara et al. | |
| 8,792,810 | B2 | 7/2014 | Ito et al. | |
| 8,798,508 | B2 | 8/2014 | Yamada et al. | |
| 8,837,985 | B2 | 9/2014 | Ishida et al. | |
| 8,846,287 | B2 | 9/2014 | Yamada et al. | |
| 8,874,007 | B2 | 10/2014 | Kawamura et al. | |
| 9,026,012 | B2 | 5/2015 | Otake et al. | |
| 9,625,854 | B2 | 4/2017 | Koyanagi et al. | |
| 9,846,407 | B2 | 12/2017 | Nakamura et al. | |
| 9,921,518 | B2 | 3/2018 | Sakurai et al. | |
| 9,952,531 | B2 | 4/2018 | Ishii et al. | |
| 9,952,532 | B2 | 4/2018 | Sugiyama et al. | |
| 10,031,438 | B2 | 7/2018 | Wakabayashi et al. | |
| 10,310,447 | B2 | 6/2019 | Morishita et al. | |
| 2007/0110484 | A1* | 5/2007 | Yamada ..... | G03G 15/0818 399/286 |
| 2008/0107455 | A1 | 5/2008 | Suzuki et al. | |
| 2013/0164038 | A1 | 6/2013 | Kusaba et al. | |
| 2013/0266339 | A1 | 10/2013 | Sugiyama et al. | |
| 2017/0097580 | A1 | 4/2017 | Ishida et al. | |
| 2017/0139336 | A1 | 5/2017 | Nagaoka et al. | |
| 2017/0139346 | A1* | 5/2017 | Ishida ..... | G03G 15/0818 |
| 2019/0265609 | A1 | 8/2019 | Sakurai et al. | |
| 2019/0324382 | A1 | 10/2019 | Sugiyama et al. | |

FOREIGN PATENT DOCUMENTS

| | | |
|---|---|---|
| JP | H02-132475 | 5/1990 |
| JP | H04-034473 | 2/1992 |
| JP | H04-88382 | 3/1992 |
| JP | H04-315181 | 11/1992 |
| JP | 2968979 | 11/1999 |

OTHER PUBLICATIONS

U.S. Appl. No. 16/524,794, Shohei Urushihara, filed Jul. 29, 2019.
U.S. Appl. No. 16/525,693, Seiji Tsuru, filed Jul. 30, 2019.
U.S. Appl. No. 16/526,125, Sosuke Yamaguchi, filed Jul. 30, 2019.
U.S. Appl. No. 16/540,463, Noriyuki Doi, filed Aug. 14, 2019.
U.S. Appl. No. 16/545,434, Kenta Matsunaga, filed Aug. 20, 2019.
U.S. Appl. No. 16/569,768, Fumihiko Utsuno, filed Sep. 13, 2019.
U.S. Appl. No. 16/672,770, Watani Moriai, filed Nov. 4, 2019.
U.S. Appl. No. 16/695,754, Kazutoshi Ishida, filed Nov. 26, 2019.

* cited by examiner

DEVELOPING ROLLER, ELECTROPHOTOGRAPHIC PROCESS CARTRIDGE AND ELECTROPHOTOGRAPHIC IMAGE FORMING APPARATUS

BACKGROUND

Field of the Invention

The present disclosure relates to a developing roller, an electrophotographic process cartridge and an electrophotographic image forming apparatus.

Description of the Related Art

As an image forming method of an electrophotographic image forming apparatus such as coping machine or optical printer, a developing method using a nonmagnetic monocomponent toner is known. In such an image forming method, a developing device is comprised of electrophotographic members as follows:

(1) A developer supply roller present in a developer container and supplying a developing roller with a toner.

(2) A developer regulating member for forming a toner layer on the developing roller and regulating the toner on the developing roller to a fixed amount.

(3) A developing roller which is placed to close the opening of the developer container having the toner housed therein and at the same time, allow a portion of it exposed from the container to face an electrophotographic photoreceptor (which may also be called "photoreceptor" hereinafter) and serves for developing the toner on the photoreceptor.

In the developing device, an image is formed by the rotation, sliding and rubbing of these electrophotographic members.

In recent years, downsizing or energy saving of a developing device is advancing. For downsizing of a developing device, downsizing of electrophotographic members, particularly, that of a roller member becomes one method. For energy saving of a developing device, reduction in torque at the time of rotation or sliding and rubbing of an electrophotographic roller member (reduction in entry amount of a member and reduction in difference in circumferential speed) becomes one method. Reduction in diameter of roller members such as developing roller or developer supply roller or reduction in torque at the time of rotation by reduction in entry amount of each member or reduction in difference in circumferential speed however may cause a shortage of the amount of a toner layer formed on the outer surface of the developing member and prevent formation of a uniform image.

Japanese Patent Application Laid-Open No. H04-88382 discloses, with a view to providing a developing roller having improved toner conveying force, a developing roller having, on the surface thereof, a dielectric part having a high electric resistance and therefore capable of conveying a toner by allowing a charged dielectric part to electrically absorb the toner thereto.

According to the investigation by the present inventors, however, the developing roller disclosed in Japanese Patent Application Laid-Open No. H04-88382 sometimes has insufficient toner conveying force under a high-temperature and high-humidity environment.

SUMMARY

One aspect of the disclosure is directed to providing a developing roller having improved toner conveying force in a high-temperature and high-humidity environment. Another aspect of the disclosure is directed to providing an electrophotographic process cartridge useful for the stable formation of a high-quality electrophotographic image. A further aspect of the disclosure is directed to providing an electrophotographic image forming apparatus capable of stably forming a high-quality electrophotographic image.

According to the one aspect of the disclosure, there is provided a developing roller having a substrate and an electro-conductive layer on the substrate. The developing roller includes, in the outer surface thereof, an electrical insulating first region and an electro-conductive second region adjacent to the first region and the developing roller further includes, in the first region in the outer surface thereof, one or more grooves.

According to another aspect of the disclosure, there is provided an electrophotographic process cartridge mounted detachably on the main body of an electrophotographic image forming apparatus. It is equipped with a developing unit and the developing unit has the above-described developing roller.

According to further aspect of the disclosure, there is provided an electrophotographic image forming apparatus having an image carrier for carrying an electrostatic latent image thereon, a charging device for primarily charging the image carrier, an exposure device for forming the electrostatic latent image on the primarily charged image carrier, a developing device for developing the electrostatic latent image with a toner to form a toner image and a transfer device for transferring the toner image to a transfer material. In the apparatus, the developing device has the above-described developing roller.

Further features of the present disclosure will become apparent from the following description of exemplary embodiments with reference to the attached drawings.

DESCRIPTION OF THE EMBODIMENTS

<Developing Roller>

Figure 1:
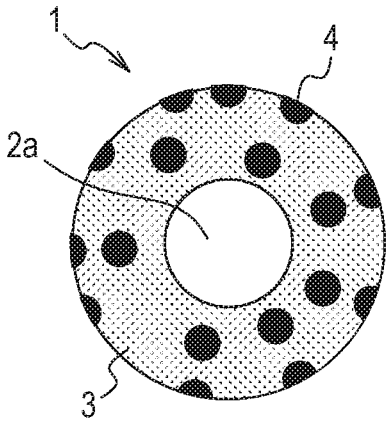
FIG. 1 is a schematic cross-sectional view showing the developing roller according to the one aspect of the disclosure.

The developing roller according to the one aspect of the disclosure has a substrate and an electro-conductive layer on the substrate. The developing roller has, in the outer surface of the developing roller, an electrical insulating first region and an electro-conductive second region adjacent to the first region and the developing roller has, in the first region in the outer surface thereof, one or more grooves.

In the developing roller described in Japanese Patent Application Laid-Open No. H04-88382 and having an electrical insulating region and an electro-conductive region in the outer surface of the developing roller, due to charging of the electrical insulating region, an electric field occurs between the electrical insulating region and the electro-conductive region adjacent thereto and by gradient power resulting therefrom, a toner is adsorbed to the surface of the developing roller. As a result, a stable amount of the toner can be conveyed certainly to a development region.

According to the investigation by the present inventors, however, there sometimes occurs deterioration in toner conveying force in a high-temperature and high-humidity environment. The deterioration is presumed to occur because electrical resistance in the electrical insulating region decreases in a high-temperature and high-humidity environment and this makes it difficult to charge the electrical insulating region and generate sufficient gradient power. Particularly when a space is saved by removing a developer supply roller, the developing roller itself should adsorb a toner and thereby supply a toner. The developing roller having reduced gradient power cannot carry a sufficient amount of a toner on its outer surface, which may result in reduction in image density.

As a result of investigation of the above-described problem, the present inventors have found that by providing one or more grooves in the first region, a decrease in the amount of a developer which can be attracted to the vicinity of the first region in a high-temperature and high-humidity environment can be suppressed.

The first region having one or more grooves can attract a larger amount of a developer because by a so-called edge effect due to the presence of grooves in the surface of the first region, electric lines of force concentrate on a protruding portion, making it possible to form an electric field densely between the first region and a second region adjacent thereto and as a result, to enhance a gradient power.

The groove in the electrical insulating first region preferably extends in a direction crossing, with an angle, a direction orthogonal to the circumferential direction of the developing roller. The groove in the electrical insulating first region more preferably has a narrow angle, which is formed with respect to the circumferential direction of the developing roller, of 0° or more to 45° or less. When the developing roller has such a constitution, the distribution of gradient power (toner grasping power) is formed and the flow of a toner at the interface between the dielectric part and the electro-conductive part can be formed stably. As a result, fusion of the toner to the surface of the developing roller can be suppressed and a durable and stable coating condition can be maintained.

The electrical insulating first region is formed by subjecting the surface of the developing roller having electrically insulating particles in the electro-conductive layer thereof to predetermined polishing and thereby exposing them. The polished surface of the electrically insulating particles exposed by polishing constitutes the electrical insulating first region and a region around it constitutes the electro-conductive second region. In the developing roller obtained in such a manner, the electrical insulating first region has a substantially round shape.

The electrical insulating first region is preferably comprised of a plurality of domains independent from each other. By such a constitution, an electric field is generated efficiently and gradient power enough for conveying a sufficient amount of a toner can be produced.

When a square region 300 μm on each side is placed on the outer surface of the developing roller, 50% or more of the total number of the domains included in the region has preferably a circle equivalent diameter of from 3 to 15 When the circle equivalent diameter falls within this range, an electric field is generated efficiently and gradient power enough for conveying a sufficient amount of a toner can be produced.

When a square region 300 μm on each side is placed on the outer surface of the developing roller, at least one of the domains included in the region and having a circle equivalent diameter of from 3 to 15 μm has preferably a plurality of the grooves, more preferably four or more grooves. With an increase in the number of the grooves, an electric field concentrates on a protruding portion due to the edge effect so that the electric field is formed more densely. This results in enhancement of the gradient power and more improvement in toner conveying property.

Further, the pitch of these grooves is preferably from 0.5 to 5.0 μm on average. When the average of the pitch of the grooves falls within the above range, the edge effect is exhibited fully, leading to enhancement of the gradient power.

When a square region 300 μm on each side is placed on the outer surface of the developing roller, an average depth of the grooves which the domains having a circle equivalent diameter of from 3 to 15 μm included in the region each have is preferably from 0.5 to 5.0 μm. When the depth of the grooves falls within the above range, the edge effect is exhibited fully, leading to enhancement of the gradient power.

When a square region 300 μm on each side is placed on the outer surface of the developing roller, a percentage of the area of the domains included in the region is preferably 10% or more to 60% or less. When the percentage of the area of the domains falls within the above range, an electric field is generated efficiently and gradient power enough for conveying a sufficient amount of a toner can be produced.

When the potential of the surface of the electrical insulating first region constituting the outer surface of the developing roller is charged to $V_0$ (V), a potential damping time constant defined as time required for damping the surface potential to $V_0 \times (1/e)$ (V) is preferably 60.0 seconds or more. Within this range, the electrical insulating first region is charged smoothly and at the same time, the potential by charging can be easily retained.

When the potential of the surface of the electro-conductive second region constituting the outer surface of the developing roller is charged to $V_0$ (V), a potential damping time constant defined as time required for damping the surface potential to $V_0 \times (1/e)$ (V) is preferably less than 6.0 seconds. Within this range, charging of the electro-conductive second region is suppressed, which facilitates generation of a potential difference with the charged electrical insulating first region and exhibition of gradient power.

(Substrate)

The substrate has conductivity and has a function of supporting an electro-conductive layer to be provided thereon. Examples of the material of the substrate include metals such as iron, copper, aluminum and nickel and alloys containing any of these metals such as stainless steel, duralumin, brass and bronze. The surface of the substrate can be plated in order to impart it with scratch resistance without damaging its conductivity. As the substrate, a substrate obtained by coating the surface of a base material made of a resin with a metal to impart surface conductivity to it or that made of an electro-conductive resin composition can be used.

(Electro-Conductive Layer)

Figure 3:
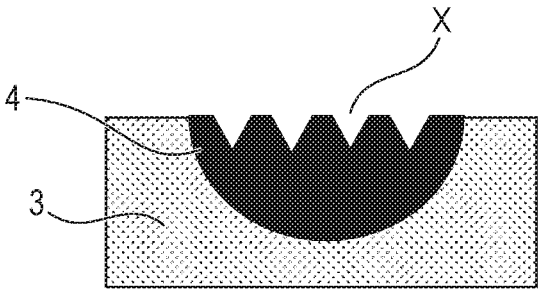
FIG. 3 is a further schematic cross-sectional view showing the developing roller according to the one aspect of the disclosure.

The electro-conductive layer has a one-layer structure or a stacked structure of two or more layers. FIG. 1 is a schematic cross-sectional view showing one example of a developing roller having, as an electro-conductive layer thereof, a one-layer structure. When the electro-conductive layer has a one-layer structure, a substrate 2*a* has thereon an electro-conductive layer having electrically insulating particles dispersed therein. An electrical insulating first region 4 made of the component of electrically insulating particles has one or more grooves and is exposed from the uppermost surface of the developing roller. An electro-conductive second region 3 made of a component constituting the electro-conductive layer is adjacent to the electrical insulating first region 4. FIG. 3 is a schematic cross-sectional view showing one example of the developing roller having an electrical insulating first region 4 having a groove X and the electro-conductive second region 3.

The electro-conductive layer contains a resin or an elastic material such as rubber. The following are specific examples of the resin or rubber:

polyurethane resins, polyamide, urea resins, polyimide, melamine resins, fluoroplastics, phenolic resins, alkyd resins, silicone resins, polyester, ethylene-propylene-diene copolymer rubbers (EPDM), acrylonitrile-butadiene rubbers (NBR), chloroprene rubbers (CR), natural rubbers (NR), isoprene rubbers (IR), styrene-butadiene rubbers (SBR), fluororubbers, silicone rubbers, epichlorohydrin rubbers, hydrides of NBR and urethane rubbers.

Of these, silicone rubbers are preferred. Examples of the silicone rubbers include polydimethylsiloxane, polymethyltrifluoropropylsiloxane, polymethylvinylsiloxane, polyphenylvinylsiloxane and copolymers of these siloxanes.

These resins or rubbers may be used either singly or in combination of two or more if necessary. Of these, polyurethane resins are preferred because they are excellent in toner triboelectric charging performance and excellent in flexibility so that they easily give contact opportunities with the toner, and have abrasion resistance. The material of the resin or rubber can be identified by measuring the electro-conductive layer with a Fourier transform infrared spectrophotometer.

The electro-conductive layer contains a conducting agent so as to impart conductivity to the electro-conductive layer. Examples of the conducting agent include ion conducting agents and electron conducting agents such as carbon black. Carbon black is preferred because it can control the conductivity of the electro-conductive layer and toner charging performance of the conducting layer. The electro-conductive layer usually has a volume resistivity of preferably $1\times10^{3}$ Ω·cm or more to $1\times10^{12}$ Ω·cm or less.

Specific examples of the carbon black include electro-conductive carbon blacks such as KETJENBLACK (trade name; product of Lion) and acetylene black and carbon blacks for rubber such as SAF, ISAF, HAF, FEF, GPF, SRF, FT and MT. Additional examples include oxidized carbon black for color ink and thermally decomposed carbon black. An addition amount of carbon black is preferably 5 parts by mass or more to 50 parts by mass or less based on 100 parts by mass of the resin or rubber. The content of carbon black in the electro-conductive layer can be measured using a thermogravimetric analyzer (TGA).

In addition to the above-described examples of the carbon black, the following conducting agents can be used. Examples include graphite such as natural graphite and artificial graphite, powders of a metal such as copper, nickel, iron and aluminum, powders of a metal oxide such as titanium oxide, zinc oxide and tin oxide and electro-conductive polymers such as polyaniline, polypyrrole and polyacetylene. They can be used either singly or in combination of two or more if necessary.

The material for forming an electro-conductive layer contains electrically insulating particles as a material constituting the electrical insulating first region. As the electrically insulating particles, fine particles of a polyurethane resin, a polyester resin, a polyether resin, a polyamide resin, an acrylic resin, a polycarbonate resin, a polyolefin resin, or the like can be used. The electrically insulating particles have preferably a volume average particle size of 3 μm or more to 30 μm or less. The amount of the particles contained in the electro-conductive layer is preferably 1 part by mass or more to 70 parts by mass or less based on 100 parts by mass of the resin or rubber. The electrical insulating first region has preferably a volume resistivity of $1.0\times10^{13}$ Ω·cm or more.

The electro-conductive layer may contain a charge control agent, a lubricant, a filler, an antioxidant, an aging preventive, or the like without damaging the respective functions of the resin or rubber and the conducting agent.

The electro-conductive layer has preferably a thickness of 1 μm or more to 5 mm or less. When the electro-conductive layer has a stacked structure of two or more layers, the thickness means the thickness of the whole conductive layer. The thickness of the electro-conductive layer can be determined by observing/measuring the cross-sectional surface of it under an optical microscope.

Examples of a method of forming an electro-conductive layer on a substrate include a method of forming with a mold, an extrusion method, an injection molding method and a method of forming by coating. In the method of forming with a mold, an insert piece for retaining a substrate in a cylindrical mold is fixed at both ends of the mold and an inlet is formed in the insert piece. Then, after the substrate is placed in the mold and the electro-conductive layer forming materials are poured from the inlet, the mold is heated at a temperature for curing the materials. Then, the cured product can be removed from the mold. In the extrusion method, a substrate and electro-conductive layer forming materials are co-extruded using, for example, a crosshead extruder and then, these materials are cured. Thus, an electro-conductive layer can be formed around the substrate.

The surface of the layer of the electro-conductive layer forming materials thus obtained is subjected to predetermined polishing to expose at least some of the electrically insulating particles in the layer from the outer surface of the developing roller or to make a groove in the exposed portion of the particles from the outer surface of the developing roller. Thus, an electrical insulating first region having one or more grooves therein can be formed on the outer surface of the developing roller. Examples of a method of polishing the surface of the layer of the electro-conductive layer forming materials include a method of polishing the surface with an abrasive such as abrasive film or sandpaper. Microgrit used for polishing as the abrasive has preferably a grain size (grit size) of #400 (Japanese Industrial Standards (JIS) R6001-2: 2017) or more to #5000 or less. For accurately forming grooves, as a polishing method such as centerless grinding is preferably employed. Examples of a method of forming grooves more accurately include a method of polishing the surface of the electro-conductive layer with an abrasive plate having unevenness formed accurately thereon by laser processing. By this method, a groove can be formed accurately in the electrical insulating part.

In using the above-described abrasive film or sandpaper, the shape of the groove can be controlled by a pushing pressure applied to a workpiece, the number of revolutions of the workpiece, or a descending speed of the film. The pushing pressure to be applied to the workpiece can be set at, for example, from 0.1 N to 50 N. The number of revolutions of the workpiece can be set at, for example, from 3 rpm to 10000 rpm. The descending speed of the film can be set at, for example, from 5 mm/sec to 50 mm/sec. To accurately make grooves in the electrical insulating first region, the electrical insulating first region is preferably harder than the electro-conductive second region, in other words, the electrically insulating particles are harder than the second region. When there is a difference in hardness between the electrical insulating first region and the electro-conductive second region, the harder one is ground more by surface polishing so that a groove can be formed stably in the electrical insulating first region. It is to be noted that the polishing step may be performed in repetition if necessary.

In the developing roller according to the present aspect, it is preferred that a first surface of the electro-conductive layer on the side not a side opposite to the substrate constitutes the electro-conductive second region, in other words, the electrical insulating first regions gather on the side opposite to the substrate and the electrical insulating first regions in contact with the substrate portion are not present. Since the electro-conductive second region is present on the whole surface on the side of the substrate, charges which have accumulated on the surface of the developing roller can be allowed to flow away appropriately and retention of unnecessary charges which may be a factor for deteriorating an image quality can be eliminated. The developing roller according to the present aspect is therefore also excellent in use for a long period of time.

When the developing roller according to the present aspect is obtained by polishing the surface of the electro-conductive layer, it is preferred that the electrical insulating part of the electro-conductive layer is maintained to be exposed from a side of the electro-conductive layer not on a side opposite to the substrate and the exposed portion of the electrical insulating part constitutes the first region, in other words, the electro-conductive layer has, inside thereof, an electrical insulating part constituting the electrical insulating first region and the uppermost surface of the electrical insulating part has a height equal to (flush with) that of the uppermost surface of the electro-conductive second region. When the electro-conductive layer has a flush surface, an electrical field thus produced becomes stable and gradient power can be exhibited more effectively.

In the disclosure, when the electro-conductive layer has therein an electrical insulating part and the uppermost surface of the electrical insulating part has a height equal to that of the uppermost surface of the electro-conductive layer, such a state will be called "flush", while when the uppermost surface of the electrical insulating part has a height with respect to the uppermost surface of the electro-conductive layer, such a state will be called "protruding".

(Confirmation of the First Region and Second Region)

Presence of the first region and the second region can be confirmed by observing the presence of two or more regions on the outer surface of the developing roller under an optical microscope, scanning electron microscope or the like. Further, it can be confirmed that the first region is electrical insulating and the second region is electro-conductive by charging the outer surface of the developing roller including the first region and the second region and then measuring the residual potential distribution thereof.

The residual potential distribution can be determined by sufficiently charging the outer surface of the developing roller by using a charging device such as corona discharge device and then measuring the residual potential distribution of the charged outer surface of the developing roller with an electrostatic force microscope (EFM), a surface potential microscope (KFM) or the like.

The electrical insulating properties of the electrical insulating part constituting the first region and the conductivity of the electro-conductive part constituting the second region can also be evaluated by, in addition to a volume resistivity, a potential damping time constant. The potential damping time constant is defined as a time required for damping of a residual potential to 1/e of an initial value and it serves as an indicator how easily a charged potential is retained, in which e is the base of natural logarithms.

The potential damping time constant of the electrical insulating first region equal to or more than 60.0 seconds is preferred because it enables smooth charging of the electrical insulating first region and at the same time facilitates retention of the potential obtained by charging. On the other hand, the potential damping time constant of the electro-conductive second region less than 6.0 seconds is preferred because it suppresses charging of the electro-conductive second region and makes it easy to cause a potential difference between the second region and the charged electrical insulating first region and exhibit gradient power.

It is to be noted that in the measurement of the potential damping time constant, when a residual potential is substantially 0 V at the measurement starting point in the below-described measuring method, in other words, when a potential has been completely damped at the measurement starting point, the time constant at the measurement point is regarded as less than 6.0 seconds. The potential damping time constant can be determined, for example, by sufficiently charging the outer surface of the developing roller by using a charging device such as corona discharge device and then measuring a time-dependent change of the residual potential of the first region and the second region of the charged outer surface of the developing roller by an electrostatic force microscope (EFM).

When the developing roller according to the present aspect is used in a nonmagnetic mono-component contact development process, the electro-conductive layer has preferably a stacked structure of two or more layers. Described specifically, the developing roller has preferably, on an electro-conductive elastic layer as a first electro-conductive layer, a first region having an electrical insulating surface and a second region having an electro-conductive surface as components constituting the surface layer of a second layer.

Figure 2:
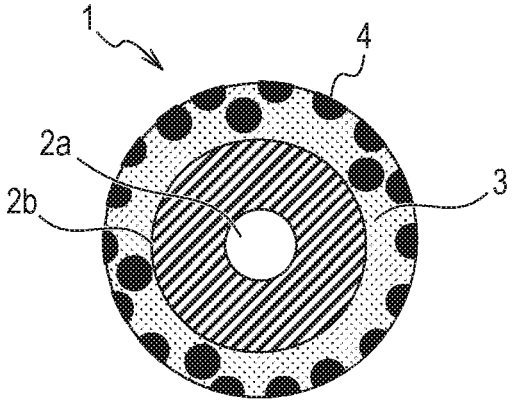
FIG. 2 is another schematic cross-sectional view showing the developing roller according to the one aspect of the disclosure.

As an example of the electro-conductive layer having a two-layer structure, the constitution as shown in FIG. 2 is preferred in which an electro-conductive elastic layer 2*b* is provided as the first electro-conductive layer on the circumferential surface of a substrate 2*a* and on the uppermost surface of the elastic layer, the electro-conductive layer according to the present aspect is provided as the second electro-conductive layer (surface layer). By adding a conducting agent to the resin or rubber, the resin or rubber thus made electro-conductive becomes an electro-conductive second region 3. By adding electrically insulating particles to the resin or rubber and then polishing, an insulating region, that is, an electrical insulating first region 4 is formed on the resin or rubber thus made electro-conductive. In such a manner, the developing roller of the present aspect having, on the uppermost surface thereof, the electro-conductive layer including the electrical insulating first region 4 and the electro-conductive second region 3 can be obtained.

The developing roller having an electro-conductive layer with a stacked structure of two or more layers is preferred because the electrical insulating first regions exposed from the uppermost surface of the developing roller have almost the same size and the toner conveying force can be made uniform on the surface of the developing roller. The surface layer of the developing roller having an electro-conductive layer with a stacked structure of two or more layers has preferably a thickness of 3 μm or more to 50 μm or less. The thickness of the surface layer falling within the above-described range enables the electrically insulating particles to exist stably in the electro-conductive layer and as a result, the above-described effect can be exhibited more. This effect is exhibited more effectively when the electrical insulating first region is made of the electrically insulating particles. As a method of polishing the surface of the surface layer when the electro-conductive layer has a stacked structure of two or more layers, a method similar to that used for obtaining the developing roller having an electro-conductive layer with a one layer structure can be used.

When the electro-conductive layer has a stacked structure of two or more layers, the electro-conductive layer having a one layer structure is suited for use as the surface layer which becomes the upper most surface. When the electro-conductive layer has a stacked structure of two or more layers, the electro-conductive layer having a one layer structure is also suited for use as a layer on the side closer to the substrate than the uppermost surface, that is, as the electro-conductive elastic layer. It is however not essential to add electrically insulating particles into the electro-conductive elastic layer.

Even when the electro-conductive layer has a one layer structure or a stacked structure of two or more layers, the electrical insulating first region according to the present aspect is formed by subjecting the surface of the developing roller having, in the electro-conductive layer thereof, electrically insulating particles to predetermined polishing and thus, exposing the grains. A polished surface of the electrically insulating particles exposed to the outer surface of the developing roller, having one or more groove(s) obtained by the polishing, constitutes the electrical insulating first region. A region therearound constitutes the electro-conductive second region. Thus, a domain constitution is formed in which the respective surfaces of the electrically insulating particles thus polished having a substantially round shape are exposed and they are independent from each other with the electro-conductive second region as a boundary region of them.

A measuring method of each parameter will hereinafter be described. In the following description, the term "insulating domain" means "electrical insulating first region" when the electrical insulating first region is obtained by polishing the surface of a developing roller having, in the electro-conductive layer thereof, electrically insulating particles.

[Method of Calculating the Narrow Angle of Grooves Formed in the Electrical Insulating First Region]

A narrow angle formed in the electrical insulating first region in a circumferential direction of a developing roller is measured as follows.

The surface of a developing roller is observed by attaching a 20× objective lens to a laser microscope ("VK-8700", trade name; product of Keyence). Then, tilt correction of the observed image thus obtained is performed. The tilt correction is performed in a quadric correction mode. From a square region 300 μm on each side at the center of the corrected image, one groove is selected and an angle formed between a line connecting between the starting point and the end point of the groove and a circumferential direction of the developing roller is calculated. This operation is performed for all the grooves present in the region and an arithmetic mean value of the angles thus obtained is designated as the narrow angle of the groove formed in the electrical insulating first region.

(Method of Measuring the Circle Equivalent Diameter of Insulating Domains and Method of Calculating the Percentage of the Number of Insulating Domains Having a Circle Equivalent Diameter of from 3 to 15 μm)

The circle equivalent diameter of insulating domains is measured as follows.

The surface of the developing roller is observed by attaching a 20× objective lens to a laser microscope ("VK-8700", trade name; product of Keyence). Next, tilt correction of the observed image thus obtained is performed. The tilt correction is performed in a quadric correction mode. In a square region 300 μm on each side at the center of the corrected image, the number of insulating domains is counted and an exposed area of each of the insulating domains is measured. The measurement is performed using an image processing software such as ImageJ. The exposed area of each domain is converted into a circle equivalent diameter. From the data thus obtained, the percent of the number of insulating domains having a circle equivalent diameter of from 3 to 15 μm is calculated. In the measurement, all the insulating domains completely included in the square region 300 μm on each side are measured and the insulating domains not completely included in the region are omitted from the measurement.

[Method of Measuring the Percentage of the Area of Insulating Domains]

The percentage of the area of insulating domains is measured as follows.

The surface of the developing roller is observed by attaching a 20× objective lens to a laser microscope ("VK-8700", trade name; product of Keyence). Then, tilt correction of the observed image thus obtained is performed. The tilt correction is performed in a quadric correction mode. In a square region 300 μm on each side at the center of the corrected image, the exposed area of each of insulating domains is measured. The measurement is performed using an image processing software such as ImageJ. The exposed areas thus measured are added and the percentage of the area of the insulating domains is calculated. In the measurement, all the insulating domains completely included in the square region 300 μm on each side are measured and the insulating domains not completely included in the region are omitted from the measurement.

[Method of Measuring the Number of Grooves in Insulating Domains]

The number of the grooves in insulating domains is counted as follows.

The surface of the developing roller is observed by attaching a 20× objective lens to a laser microscope ("VK-8700", trade name; product of Keyence). Then, tilt correction of the observed image thus obtained is performed. The tilt correction is performed in a quadric correction mode. From insulating domains in a square region 300 μm on each side at the center of the corrected image, insulating domains having a circle equivalent diameter of from 3 to 15 μm are selected. Profile measurement is performed at a portion of one insulating domain having the widest domain width. Using the highest portion within the range subjected to profile measurement as a standard, a recess having a depth of 0.2 μm or more with respect to this standard is designated as a groove and the number of grooves is counted. The number thus obtained is designated as the number of the grooves in this insulating domain. This operation is performed for all the insulating domains having a circle equivalent diameter of from 3 to 15 μm in the observed image. The term "the number of grooves" in Examples of the disclosure means the number of the grooves in the insulating domain having the least number of grooves among the insulating domains having a circle equivalent diameter of from 3 to 15 μm.

[Method of Measuring the Depth of Grooves in Insulating Domains]

The depth of grooves in each of the insulating domains is measured as follows.

The surface of the developing roller is observed by attaching a 20× objective lens to a laser microscope ("VK-8700", trade name; product of Keyence). Next, tilt correction of the observed image thus obtained is performed. The tilt correction is performed in a quadric correction mode. From insulating domains in a square region 300 μm on each side at the center of the corrected image, insulating domains having a circle equivalent diameter of from 3 to 15 μm are selected. Profile measurement is performed at a portion of one insulating domain having the widest domain width. Using the highest portion within the range subjected to profile measurement as a standard, a recess having a recessed degree of 0.2 μm or more with respect to this standard is designated as a groove and the recessed degree is designated as the depth of this groove. This operation is performed for all the insulating domains having a circle equivalent diameter of from 3 to 15 μm in the observed image. An arithmetic mean value of the depths of all the grooves thus measured for one insulating domain is designated as the depth of the groove of this domain.

[Method of Measuring the Pitch of Grooves in Insulating Domains]

The pitch of grooves in each of the insulating domains is measured as follows.

The surface of the developing roller is observed by attaching a 20× objective lens to a laser microscope ("VK-8700", trade name; product of Keyence). Then, tilt correction of the observed image thus obtained is performed. The tilt correction is performed in a quadric correction mode. From insulating domains in a square region 300 μm on each side at the center of the corrected image, insulating domains having a circle equivalent diameter of from 3 to 15 μm are selected. Profile measurement is performed at a portion of one insulating domain having the widest domain width. Using the highest portion within the range subjected to profile measurement as a standard, a recess having a recessed degree of 0.2 μm or more with respect to this standard is designated as a groove and a distance between the most recessed portions of the grooves is designated as a pitch of the grooves. This operation is performed for all the insulating domains having a circle equivalent diameter of from 3 to 15 μm in the observed image. An arithmetic mean value of all the pitches of the grooves thus measured for one of the insulating domains is designated as a pitch of the grooves in the domain.

[Observation of the Outer Surface of a Developing Roller]

The following is one example of a method of observing the outer surface of a developing roller.

First, the outer surface of a developing roller is observed using an optical microscope ("VHX5000", trade name; product of Keyence) and presence of two or more regions on the outer surface is confirmed. Then, with a cryomicrotome ("UC-6", trade name; product of Leica Microsystems), a thin section including the outer surface of the developing roller is cut out from the developing roller. This thin section is cut out at a temperature of −150° C. so that the outer surface of the developing roller has a size of 50 μm×50 μm and a thickness of 1 μm with respect to the outer surface of the electro-conductive layer and includes two or more regions on the outer surface of the developing roller. Then, the outer surface of the developing roller on the thin section thus obtained is observed with the optical microscope.

[Measurement of Residual Potential Distribution]

The following is one example of a method of measuring a residual potential distribution.

A residual potential distribution can be determined by corona-charging the outer surface of the developing roller on the thin section with a corona discharge device and measuring a residual potential of the outer surface with a surface potential microscope ("MFP-3D-Origin", trade name; product of Oxford Instruments) while scanning the thin section.

First, the thin section is placed on a smooth silicon wafer with a surface including the outer surface of the developing roller up and is left to stand in an environment of a temperature of 23° C. and a relative humidity of 50% for 24 hours.

Next, the silicon wafer having the thin section thereon is set, in the same environment, on a high-precision XY stage. As the corona discharge device, that having a wire-grid electrode distance of 8 mm is used.

The corona discharge device is placed at a position to give a distance of 2 mm between the grid electrode and the surface of the silicon wafer. Then, the silicon wafer is grounded and voltages of −5 kV and −0.5 kV are applied to the wire and the grid electrode, respectively, from an external power supply. After the application is started, the thin section is scanned at a speed of 20 mm/sec in parallel to the surface of the silicon wafer by using the high-precision XY stage so that it passes just below the corona discharge device and thus, the outer surface of the developing roller on the thin section is corona-charged.

Then, the thin section is set on the surface potential microscope so that the surface including the outer surface of the developing roller on the thin section becomes a measured surface and a residual potential distribution is measured. The following are measurement conditions.

Measurement environment: temperature of 23° C. and relative humidity of 50%

Time from the passage of the thin section just below the corona discharge device to start of measurement: 20 seconds Cantilever: "OMCL-AC250™", trade name; product of Olympus Gap between a surface to be measured and a tip of cantilever: 50 nm Measurement range: 50 μm×50 μm Measurement interval: 200 nm×200 nm (50 μm/256)

By studying the presence or absence of the residual potential in two or more regions present on the thin section based on the residual potential distribution obtained by the above-described measurement, whether the region is an electrical insulating first region or an electro-conductive second region is checked. More specifically, by regarding one of the two or more regions including a portion whose absolute value of the residual potential is less than 1 V as the second region and another one including a portion whose absolute value of the residual potential is larger than the absolute value of the residual potential of the second region by 1 V or more as the first region, their presence is confirmed.

The above-described method of measuring a residual potential distribution is one example and the device and conditions may be changed into those suited for confirmation of the presence or absence of a residual potential of the two or more regions, depending on the size, distance, or time constant of the electrical insulating part or electro-conductive layer.

[Measurement of Potential Damping Time Constant]

The following is one example of a method of measuring a potential damping time constant.

A potential damping time constant is determined by corona-charging the outer surface of a developing roller with a corona discharge device, measuring a time-dependent change of the residual potential on the electrical insulating part or on the electro-conductive part present on the outer surface by an electrostatic force microscope ("MODEL 1100TN", trade name; product of Trek Japan) and fitting the measured result in the following formula (1). The measurement point of the electrical insulating part is a point of the first region, whose presence is confirmed by the measurement of the residual potential distribution, having the largest absolute value of the residual potential. The measurement point of the electro-conductive part is a point of the second region, whose presence is confirmed by the measurement of the residual potential distribution, having a residual potential of substantially 0 V.

First, the thin section used for the measurement of a residual potential distribution is placed on a smooth silicon wafer with a surface of the thin section including the outer surface of the developing roller up and was left to stand in an environment of a temperature of 23° C. and a relative humidity of 50% for 24 hours.

Then, the silicon wafer having the thin section thereon is set, in the same environment, on a high-precision XY stage loaded on the electrostatic force microscope. As the corona discharge device, that having a wire-grid electrode distance of 8 mm is used. The corona discharge device is placed at a position to give a distance of 2 mm between the grid electrode and the surface of the silicon wafer. Next, the silicon wafer is grounded and voltages of −5 kV and −0.5 kV are applied to the wire and the grid electrode, respectively, from an external power supply. After the application is started, the thin section is scanned at a speed of 20 mm/sec in parallel to the surface of the silicon wafer by using the high-precision XY stage so that it passes just below the corona discharge device and thus, the thin section is corona-charged.

Then, by using the high-precision XY stage, the measurement point of the electrical insulating part or electro-conductive part is moved to just below the cantilever of an electrostatic force microscope and a time-dependent change of a residual potential is measured. For the measurement, an electrostatic force microscope is used. The following are measurement conditions.

Measurement environment: temperature of 23° C. and relative humidity of 50%

Time from passage of the measurement position just below the corona discharge device to start of measurement: 15 seconds Cantilever: a cantilever for Model 1100TN ("Model 1100TNC-N", trade name; product of Trek Japan)

Gap between a surface to be measured and a tip of cantilever: 10 μm

Measurement frequency: 6.25 Hz

Measurement time: 1000 sec

Based on the time-dependent change of a residual potential obtained by the above-described measurement, a potential damping time constant τ is determined by fitting the data in the following formula (1) by the least-squares method.

$$V_0 = V(t) \times \exp(-t/\tau) \quad (1)$$

t: elapsed time (sec) after the measurement position passes just below the corona discharge device $V_0$: initial potential (potential at t=0 sec) (V)

V(t): residual potential (V) t seconds after the measurement position passes just below the corona discharge device τ: potential damping time constant (sec).

A potential damping time constant τ is measured at 3 points in the longer direction×3 points in the circumferential direction of the outer surface of the developing roller, that is, 9 points in total and an average value of them is used as a potential damping time constant of the electrical insulating part or the electro-conductive part. It is to be noted that when the measurement of the electro-conductive part includes a measurement point whose residual potential is substantially 0 V at the measurement start time, that is, 15 seconds after corona charge, the potential damping time constant is considered as less than the average value of the potential damping time constant of the remaining measurement points. When the potential of all the measurement points at the measurement start time is substantially 0 V, the potential damping time constant is considered as below the measuring lower limit.

<Electrophotographic Process Cartridge>

Figure 4:
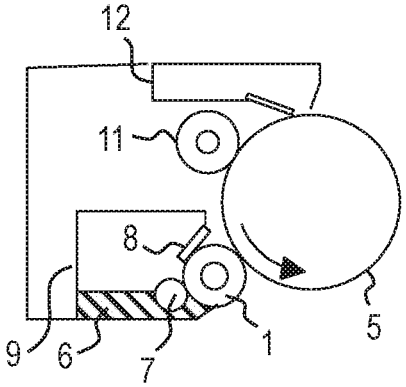
FIG. 4 is a schematic block diagram showing the electrophotographic process cartridge according to the another aspect of the disclosure.

The electrophotographic process cartridge according to the present aspect is mounted detachably on the main body of an electrophotographic image forming apparatus and it is equipped with at least a developing unit. This developing unit has the developing roller of the present aspect. One example of the electrophotographic process cartridge of the present aspect is shown in FIG. 4. The electrophotographic process cartridge shown in FIG. 4 has a developing device 9 equipped with a developing roller 1 and a developer amount regulating member 8, a photoreceptor 5, a charging device 11 and a cleaning device 12. These devices or members are integrated into one and are provided detachably on the main body of the electrophotographic image forming apparatus. Examples of the developing device 9 include those similar to a developing device provided in an image forming unit in an electrophotographic image forming apparatus which will be described later. The electrophotographic process cartridge of the disclosure has, integrated therein, the above-described members and a transfer member for transferring a toner image on the photoreceptor 5 to a recording material.

Electrophotographic Image Forming Apparatus

The electrophotographic image forming apparatus according to the present aspect has an image carrier for carrying an electrostatic latent image thereon, a charging device for primarily charging the image carrier, an exposure device for forming the electrostatic latent image on the primarily charged image carrier, a developing device for developing the electrostatic latent image with a toner to form a toner image and a transfer device for transferring the toner image to a transfer material. The developing device has the developing roller of the present aspect.

Figure 5:
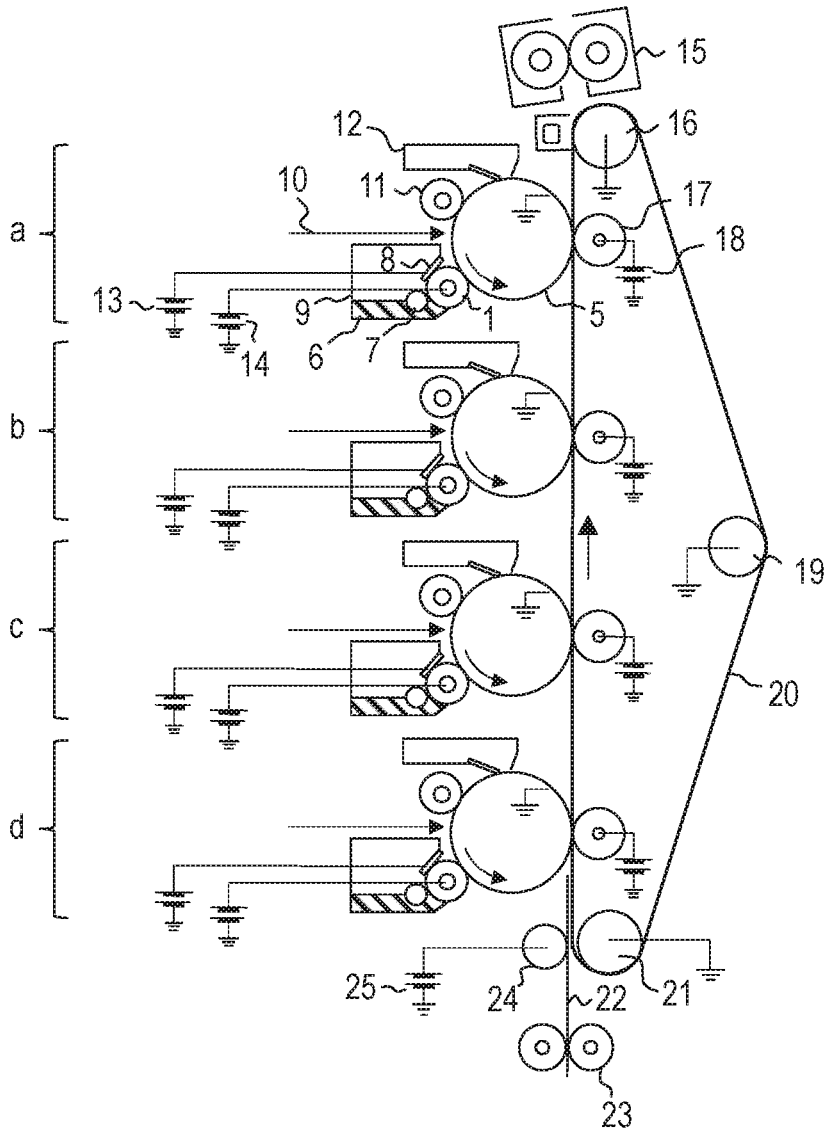
FIG. 5 is a schematic block diagram showing the electrophotographic image forming apparatus according to the further aspect of the disclosure.

One example of the electrophotographic image forming apparatus of the present aspect is shown in FIG. 5.

The electrophotographic image forming apparatus shown in FIG. 5 has image forming units (a) to (d) for respective color toners, that is, yellow toner, magenta toner, cyan toner and black toner. The image forming units (a) to (d) each have therein a photoreceptor 5 as an image carrier rotating in the arrow direction. The photoreceptors 5 each have therearound a charging device 11 for uniformly charging the photoreceptor 5, an unillustrated exposure device for exposing the uniformly charged photoreceptor 5 to a laser light 10 to form an electrostatic latent image and a developing device 9 for supplying a toner to the photoreceptor 5 having the electrostatic latent image thereon and developing the electrostatic latent image.

On the other hand, a transfer conveying belt 20 for conveying a recording material 22 such as paper sheet supplied by a paper supply roller 23 is provided while being suspended on a driving roller 16, a driven roller 21 and a tension roller 19. A charge of an adsorption bias supply 25 is applied to the transfer conveying belt 20 via an adsorption roller 24 and the recording material 22 is conveyed while being electrostatically attached to the surface of the transfer conveying belt. In addition, a transfer bias supply 18 is provided for applying a charge for transferring the toner image on the photoreceptor 5 of each of the image forming units (a) to (d) to the recording material 22 which is conveyed by the transfer conveying belt 20. A transfer bias is applied via a transfer roller 17 as a transfer device placed on the back surface of the transfer conveying belt 20. The toner images of respective colors formed by the image forming units (a) to (d) are successively superposed and transferred onto the recording material 22 conveyed by the transfer conveying belt 20 movable in synchronization with the image forming units (a) to (d), respectively. A color electrophotographic image forming apparatus is equipped further with a fixing device 15 for fixing the toner images superposed and transferred onto the recording material 22 by heating or the like and a conveying device (not shown) for discharging the recording material 22 having an image formed thereon out of the apparatus.

The image forming units are each provided with a cleaning device 12 having a cleaning blade for removing a transfer residual toner which has remained on each of the photoreceptors 5 without being transferred and thereby cleaning the surface thereof. The photoreceptors 5 thus cleaned then wait, regarded that an image can be formed thereon. The developing device 9 provided in each of the image forming units has a developer container having, housed therein, a nonmagnetic developer (toner) 6 as a mono-component developer and a developing roller 1 placed so as to close the opening of the developer container therewith and to face the photoreceptor at a portion exposed from the developer container. The developer container has therein a developer supply roller 7 for supplying the developing roller 1 with a toner and at the same time, for scraping off, after development, the toner remaining on the developing roller 1 without being used and a developer amount regulating member 8 for forming the toner on the developing roller 1 as a thin film and performing triboelectric charging. They are each placed in contact with the developing roller 1 and the developing roller 1 and the developer supply roller 7 rotate in the forward direction. To the developer amount regulating member 8 and the developing roller 1, a voltage is applied from a blade bias supply 13 and a developing roller bias supply 14, respectively.

The one aspect of the disclosure makes it possible to provide a developing roller having improved toner conveying force in a high-temperature and high-humidity environment. The another aspect of the disclosure makes it possible to provide an electrophotographic process cartridge useful for the stable formation of a high-quality electrophotographic image. The further aspect of the disclosure makes it possible to provide an electrophotographic image forming apparatus capable of stably forming a high-quality electrophotographic image.

EXAMPLES

The developing roller of the present aspect will hereinafter be described specifically by Examples.

Example 1

(Formation of First Electro-Conductive Layer)

A substrate was prepared by applying a primer ("DY35-051", trade name; product of Dow Corning Toray) to a shaft core having an outer diameter of 6 mm and a length of 270 mm and made of a stainless steel (SUS304) and then baking the resulting shaft core. The substrate thus obtained was placed in a mold and an addition type silicone rubber composition obtained by mixing the materials shown below were poured in a cavity formed in the mold. Then, the mold was heated to heat and cure the silicone rubber at a temperature of 150° C. for 15 minutes. After release from the mold, the silicone rubber was heated further at a temperature of 180° C. for one hour to complete the curing reaction. In such a manner, Elastic roller 1 having a 3-mm thick electro-conductive elastic layer (first electro-conductive layer) was produced on the outer periphery of the substrate.

| | |
|---|---|
| Liquid silicone rubber material ("SE6724A/B", trade name; product of Dow Corning Toray) | 100 parts by mass |
| Carbon black ("Toka Black #7360SB", trade name; product of Tokai Carbon) | 20 parts by mass |
| Platinum catalyst | 0.1 part by mass |

(Formation of Second Electro-Conductive Layer)

Next, a surface layer (second electro-conductive layer) having electrically insulating particles was provided on the circumferential surface of Elastic roller 1 as follows. First, materials shown below were weighed. A mixture obtained by adding MEK to the materials and uniformly dispersing the latter in the former was placed in an overflow type circulatory applying device.

| | |
|---|---|
| Polyol ("N5120", trade name; product of TOSOH) | 84 parts by mass |
| Isocyanate ("L-55E", trade name; product of TOSOH) | 16 parts by mass |
| Carbon black ("MA100", trade name; product of Mitsubishi Chemical) | 20 parts by mass |
| Electrically insulating particles 1 which were acrylic resin particles having an average particle size of 15 μm ("MX-1500", trade name; product of Soken Chemical & Engineering) | 30 parts by mass |

Then, Elastic roller 1 was dipped in the applying device. After being pulled up, it was air dried for 40 minutes. Then, by heating at a temperature of 150° C. for 4 hours, Electro-conductive elastic roller 1, of which a 20-μm thick surface layer having a protrusion derived from the electrically insulating particles, was provided on the Elastic roller 1, was obtained.

Electro-conductive elastic roller 1 was then clamped at both ends thereof and rotated at a number of revolutions of 500 rpm. Under such a state, polishing was performed by applying an alumina-oxide abrasive film ("Lapping film sheet A3-9SHT", trade name; product of 3M) having a size adjusted to 5 cm long×25 cm wide and having a grain size of 9 μm (equivalent to #2000) to Electro-conductive elastic roller 1 at a pushing pressure of 10N and descending the abrasive film from the upper portion to the lower portion of Electro-conductive elastic roller 1 at a speed of 30 mm/sec. The above polishing step was repeated 20 times to obtain Developing roller No. 1 from which the electrical insulating first region having a groove as shown in Table 2 was exposed.

The narrow angle (°) of grooves formed in the electrical insulating first region, the percentage of the number of insulating domains having a circle equivalent diameter of from 3 to 15 μm, the number of grooves in each of the insulating domains, the pitch (μm) of the grooves in each of the insulating domains, the depth (μm) of the grooves in each of the insulating domains, the percentage (%) of the area of the insulating domains and a potential damping time constant (sec) were measured by the above-described methods, respectively.

Figure 6A:
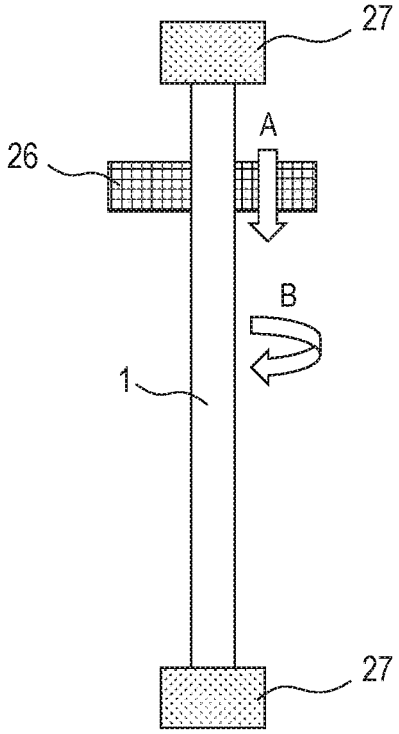
FIGS. 6A and 6B show the schematic front view and schematic top view showing one example of a polishing device to be used in the disclosure, respectively.
Figure 6B:
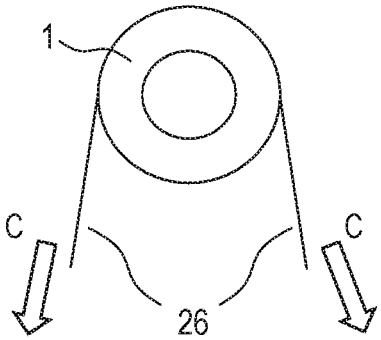

FIGS. 6A and 6B show one example of a polishing device suited for use in the disclosure, in which FIG. 6A is a front view of the polishing device and FIG. 6B is a top view of the polishing device. The developing roller 1 is clamped at both ends thereof by a chuck jig 27. With rotation of the chuck jig at a predetermined number of revolutions, an abrasive film 26 moves from the upper portion to the lower portion (in a direction of the arrow A) of the chuck at a predetermined speed and the surface of the developing roller is polished. At this time, a tension is applied from the both ends of the abrasive film in a direction shown by the arrow C. By adjusting this tension, it is possible to apply a predetermined pushing pressure to a contact portion with the developing roller and polish the roller. The pushing pressure can be measured by applying a push-pull gauge instead of the developing roller to the contact portion between the abrasive film and the developing roller. The arrow B shows the rotation of the workpiece.

Developing roller No. 1 thus obtained was evaluated for the following.

[Evaluation by Electrophotographic Image Forming Apparatus]

For torque reduction of an electrophotographic member, the gear of a developer supply roller was removed from a process cartridge ("HP 304A Magenta", trade name; product of Hewlett Packard). The developer supply roller essentially rotates in a direction opposite to a developing roller at the time of operating the process cartridge, while the developer supply roller from which the gear has been removed rotates following the developing roller. This leads to torque reduction but also causes a decrease in a toner supply amount to the developing roller. Next, Developing roller No. 1 was inserted in the gear-removed process cartridge and the resulting cartridge was loaded in a laser beam printer ("Color LaserJet CP2025", trade name; product of Hewlett Packard). The same laser beam printer was prepared further. One was left to stand in an environment of a temperature of 30° C. and a relative humidity of 80%, that is, a high-temperature and high-humidity environment (HH environment) and the other one was left to stand in an environment of a temperature of 25° C. and a relative humidity of 50%, that is, a normal temperature and normal humidity environment (NN environment), each for 24 hours. The roller surface potential evaluation and toner conveyance amount evaluation of those laser beam printers left to stand in the respective environments were performed.

(Roller Surface Potential Evaluation)

After a solid white image was output onto 50 sheets of A4 paper continuously at a speed of 28 sheets/min, output operation was terminated during outputting a sheet of a solid white image, Developing roller No. 1 was removed and the toner was removed by blowing it off. Then, the surface potential of Developing roller No. 1 was measured.

A region measured was between the photoreceptor and the developer amount regulating member at the time when the output operation was terminated. The measurement method was as follows. The substrate of Developing roller No. 1 was grounded and the surface potential of Developing roller No. 1 was determined by connecting a surface potential probe ("MODEL6000B-8", trade name; product of Trek) to a surface potentiometer ("MODEL344", trade name; product of Trek) and measuring a value at a position distant by 1 mm from the surface of Developing roller No. 1. The resulting roller surface potential is a characteristic value of a developing roller exhibiting toner conveying force. A high roller surface potential means high toner conveying force. The evaluation was performed in each of the HH environment and the NN environment and a rate of change of a surface potential was calculated by dividing a difference in the surface potential between in the HH environment and in the NN environment by the surface potential in the NN environment. The surface potential and rate of change in each of the environments are shown in Table 3.

(Evaluation of Toner Conveyance Amount)

After a solid black image was output onto a sheet of A4 paper at a speed of 28 sheets/min, the operation of the printer was terminated at a rear end portion of the image during output of the solid black image on the second sheet. The toner was sucked to the outer surface of Developing roller No. 1 through a suction nozzle having an opening with a diameter of 5 mm and, from the mass of the toner thus sucked and an area of a sucked region, a toner conveyance amount ($mg/cm^2$) per unit area of the outer surface of Developing roller No. 1 was calculated. The evaluation was performed in each of the HH environment and NN environment and a rate of change in toner conveyance amount, that is, a value obtained by dividing a difference in toner conveyance amount between in the NN environment and the HH environment by the toner conveyance amount in the NN environment was calculated. The toner conveyance amount in each environment and the rate of change are shown in Table 4.

Example 2

In a manner similar to that of Example 1 except that the abrasive film used in Example 1 was replaced by sandpaper #1000, Developing roller No. 2 from which an electrical insulating part having therein a groove as shown in Table 2 was exposed was obtained. Evaluation results are shown in Tables 3 and 4.

Example 3

In a manner similar to that of Example 1 except that the polishing performed in Example 1 was replaced by centerless grinding using a grinding stone with a grit size of #220, Developing roller No. 3 from which an electrical insulating part having therein a groove as shown in Table 2 was exposed was obtained. Evaluation results are shown in Tables 3 and 4.

Example 4

The polishing performed in Example 1 was changed as described below. First, as an abrasive plate, a semicircular aluminum plate having a radius of curvature of 6 mm and a height of 5 cm on the surface of which grooves having a height of 4 μm and a pitch of 2 μm were processed accurately by laser, was prepared. Then, polishing was performed by applying, to the abrasive plate, the surface of Electro-conductive elastic roller 1 at a pushing pressure of 10 N while rotating it and descending the abrasive plate at a speed of 30 mm/sec from the upper portion to the lower portion of Eelectro-conductive elastic roller 1. The above polishing step was performed 20 times in repetition to obtain Developing roller No. 4 from which an electrical insulating part having therein a groove as shown in Table 2 was exposed. Evaluation results are shown in Tables 3 and 4.

Examples 5 to 8

In a manner similar to that of Example 1 except that the addition amount of Electrically insulating particles 1 ("MX-1500", trade name; product of Soken Chemical & Engineering) used in Example 1 was changed to 10 parts by mass, 60 parts by mass, 7 parts by mass and 70 parts by mass, Developing rollers Nos. 5 to 8 from which an electrical insulating part having therein a groove as shown in Table 2 was exposed were obtained, respectively. Evaluation results are shown in Tables 3 and 4.

Examples 9 to 13

In a manner similar to that of Example 1 except that the pushing pressure of the abrasive film applied in Example 1 to Electro-conductive elastic roller 1 was changed to 15 N, 5 N, 20 N, 3 N and 30 N, Developing rollers Nos. 9 to 13 from which an electrical insulating part having therein a groove as shown in Table 2 was exposed were obtained, respectively. Evaluation results are shown in Tables 3 and 4.

Examples 14 to 17

In a manner similar to that of Example 1 except that the repeat count of the polishing step in Example 1 was changed to 50, 10, 70 and 3, Developing rollers Nos. 14 to 17 from which an electrical insulating part having therein a groove as shown in Table 2 was exposed were obtained, respectively. Evaluation results are shown in Tables 3 and 4.

Examples 18 to 20

In a manner similar to that of Example 1 except that the abrasive film used in Example 1 was changed to sandpaper #200, #400 and #600 and the repeat count of the polishing step was changed to 1, Developing rollers Nos. 18 to 20 from which an electrical insulating part having therein a groove as shown in Table 2 was exposed were obtained, respectively. Evaluation results are shown in Tables 3 and 4.

Examples 21 to 24

In a manner similar to that of Example 1 except that Electrically insulating particles 1 used in Example 1 were changed to Electrically insulating particles 2 to 5 shown below in Table 1, Developing rollers Nos. 21 to 24 from which an electrical insulating part having therein a groove as shown in Table 2 was exposed were obtained, respectively. Evaluation results are shown in Tables 3 and 4. The average particle size is a value listed in the catalog of the manufacturer.

TABLE 1

| Example No. | Electrically insulating particles No. | Material |
|---|---|---|
| Example 21 | Electrically insulating particles 2 | Acrylic resin particles having an average particle size of 5 μm (trade name: MX-500, product of Soken Chemical & Engineering) |
| Example 22 | Electrically insulating particles 3 | Acrylic resin particles having an average particle size of 20 μm (trade name: MX-2000, product of Soken Chemical & Engineering) |
| Example 23 | Electrically insulating particles 4 | Acrylic resin particles having an average particle size of 3 μm (trade name: MX-300, product of Soken Chemical & Engineering) |
| Example 24 | Electrically insulating particles 5 | Acrylic resin particles having an average particle size of 30 μm (trade name: MX-3000, product of Soken Chemical & Engineering) |

Example 25

In a manner similar to that of Example 1 except that the pushing pressure of the abrasive film applied in Example 1 to Electro-conductive elastic roller 1 was changed to 5 N and the repeat count of the polishing step was changed to 3, Developing roller No. 25 from which an electrical insulating part having therein a groove as shown in Table 2 was exposed was obtained. In the resulting Developing roller No. 25, the exposed portion of the electrical insulating part protruded on the surface side than the conductivity forming surface. Evaluation results are shown in Tables 3 and 4.

Example 26

In a manner similar to that of Example 1, a substrate was obtained. Then, the materials shown below were kneaded to prepare an unvulcanized rubber composition.

| | |
|---|---|
| Millable silicone rubber material ("TSE270-4U", trade name; product of Momentive Performance Materials Japan) | 100 parts by mass |
| Electrically insulating particles 1 ("MX-1500H", trade name, average particle size: 15 μm, product of Soken Chemical & Engineering) | 30 parts by mass |
| Carbon black ("Toka Black #7360SB", trade name; product of Tokai Carbon) | 10 parts by mass |
| Curing agent ("TC-8", trade name; product of Momentive Performance Materials Japan) | 0.5 part by mass |

Next, a crosshead extruder having a supply mechanism of the substrate and a discharging mechanism of the unvulcanized rubber composition was provided. A dice having an inner diameter of 10.1 mm was attached to the crosshead and the temperature of the extruder and the crosshead was adjusted to 30° C. and a conveying speed of the substrate was adjusted to 60 mm/sec. Under the above conditions, the unvulcanized rubber composition was supplied from the extruder and in the crosshead, the substrate was coated, at the outer periphery thereof, with the unvulcanized rubber composition as an electro-conductive elastic layer to obtain an unvulcanized rubber roller. Next, the unvulcanized rubber roller was placed in a hot-air vulcanization furnace of 170° C. and heated for 15 minutes. Then, the roller was polished as in Example 1 to obtain Developing roller No. 26 which had, on the outer periphery of the substrate, a 2-mm thick electro-conductive layer and from which an electrical insulating part having therein a groove as shown in Table 2 was exposed was obtained. Evaluation results are shown in Tables 3 and 4.

Examples 27 and 28

In a manner similar to that of Example 1 except that the number of revolutions of Electro-conductive elastic roller 1 of Example 1 was changed to 16 rpm and 3 rpm and the descending speed of the abrasive film upon polishing step was changed to 10 mm/sec, Developing rollers Nos. 27 and 28 from which an electrical insulating part having therein a groove as shown in Table 2 was exposed were obtained, respectively. The groove of Developing roller No. 27 had a narrow angle of 45° with respect to the circumferential direction. The groove of Developing roller No. 28 had a narrow angle of 80° with respect to the circumferential direction. Evaluation results are shown in Tables 3 and 4.

Examples 29 and 30

Polishing was performed in a manner similar to Example 1 except that the abrasive film used in Example 1 was changed to sandpapers #200 and #400, respectively; the abrasive film was descended at a speed of 30 mm/sec while setting a number of revolutions of Electro-conductive elastic roller 1 at 0 rpm, meaning without rotating the roller; and the polishing of the same surface was performed once and in order to polish the whole surface of the electro-conductive elastic roller, the electro-conductive layer was rotated as needed whenever the polishing step was finished, Developing rollers Nos. 29 and 30 from which an electrical insulating part having therein a groove as shown in Table 2 was exposed were obtained. The groove of each of Developing rollers Nos. 29 and 30 does not have an angle in a direction orthogonal to the circumferential direction. Evaluation results are shown in Tables 3 and 4.

Example 31

In a manner similar to that of Example 1 except that Electrically insulating particles 1 used in Example 1 were changed to Electrically insulating particles 6 ("Daimic beaz UCN-8150 CM Clear", trade name; product of Dainichiseika Color & Chemicals, average particle size: 15 μm), Developing roller No. 31 from which an electrical insulating part having therein a groove as shown in Table 2 was exposed was obtained. Evaluation results are shown in Tables 3 and 4.

Example 32

In a manner similar to that of Example 1 except that Electrically insulating particles 1 used in Example 1 were changed to Electrically insulating particles 7 ("SP-10", trade name; product of Toray, average particle size: 10 μm), Developing roller No. 32 from which an electrical insulating part having therein a groove as shown in Table 2 was exposed was obtained. Evaluation results are shown in Tables 3 and 4.

Example 33

In a manner similar to that of Example 1 except that the amount of the carbon back used in Example 1 was changed to 2 parts by mass, Developing roller No. 33 from which an electrical insulating part having therein a groove as shown in Table 2 was exposed was obtained. Evaluation results are shown in Tables 3 and 4.

Comparative Example 1

In a manner similar to that of Example 1 except that the abrasive film used in Example 1 was changed to a film sheet having a grain size of 0.3 μm corresponding to grit size of #15000 ("Lapping film sheet A3-0.3SHT", trade name; product of 3M) and the repeat count of the polishing step was changed to 500, Developing roller No. 34 from which an electrical insulating part having therein no groove as shown in Table 2 was exposed was obtained. Evaluation results are shown in Tables 3 and 4.

TABLE 2

| | | Developing roller No. | Angle (°) | Layer constitution | Property of electrical insulating part | Percentage of the number of domains with 3 to 15 μm circle equivalent diameter | Groove Number | Groove Pitch (μm) | Groove Depth (μm) | Area of domains (%) | Potential damping time constant: Electrical insulating part (sec) | Potential damping time constant: Electro-conductive part (sec) |
|---|---|---|---|---|---|---|---|---|---|---|---|---|
| Example | 1 | 1 | 0° | Two layers | Flush | 70 | 8 | 1 | 2 | 30 | 650 | 1 |
| | 2 | 2 | 0° | Two layers | Flush | 70 | 6 | 2 | 3 | 30 | 650 | 1 |
| | 3 | 3 | 0° | Two layers | Flush | 70 | 5 | 3 | 4 | 30 | 650 | 1 |
| | 4 | 4 | 0° | Two layers | Flush | 70 | 5 | 3 | 3 | 30 | 650 | 1 |
| | 5 | 5 | 0° | Two layers | Flush | 70 | 8 | 1 | 2 | 12 | 650 | 1 |
| | 6 | 6 | 0° | Two layers | Flush | 70 | 8 | 1 | 3 | 58 | 650 | 1 |
| | 7 | 7 | 0° | Two layers | Flush | 70 | 8 | 1 | 3 | 8 | 650 | 1 |
| | 8 | 8 | 0° | Two layers | Flush | 70 | 8 | 1 | 3 | 65 | 650 | 1 |
| | 9 | 9 | 0° | Two layers | Flush | 70 | 8 | 1 | 3 | 30 | 650 | 1 |
| | 10 | 10 | 0° | Two layers | Flush | 70 | 8 | 1 | 0.6 | 30 | 650 | 1 |
| | 11 | 11 | 0° | Two layers | Flush | 70 | 8 | 1 | 4.8 | 30 | 650 | 1 |
| | 12 | 12 | 0° | Two layers | Flush | 70 | 8 | 1 | 0.2 | 30 | 650 | 1 |
| | 13 | 13 | 0° | Two layers | Flush | 70 | 8 | 1 | 8 | 30 | 650 | 1 |
| | 14 | 14 | 0° | Two layers | Flush | 70 | 15 | 0.6 | 2 | 30 | 650 | 1 |
| | 15 | 15 | 0° | Two layers | Flush | 70 | 3 | 4.8 | 2 | 30 | 650 | 1 |
| | 16 | 16 | 0° | Two layers | Flush | 70 | 50 | 0.2 | 2 | 30 | 650 | 1 |
| | 17 | 17 | 0° | Two layers | Flush | 70 | 2 | 6 | 2 | 30 | 650 | 1 |
| | 18 | 18 | 0° | Two layers | Flush | 70 | 1 | | 0.7 | 30 | 650 | 1 |

TABLE 2-continued

| | | Developing roller No. | Angle (°) | Layer constitution | Property of electrical insulating part | Percentage of the number of domains with 3 to 15 μm circle equivalent diameter | Groove Number | Groove Pitch (μm) | Groove Depth (μm) | Area of domains (%) | Potential damping time constant Electrical insulating part (sec) | Potential damping time constant Electro-conductive part (sec) |
|---|---|---|---|---|---|---|---|---|---|---|---|---|
| | 19 | 19 | 0° | Two layers | Flush | 70 | 2 | 5 | 0.7 | 30 | 650 | 1 |
| | 20 | 20 | 0° | Two layers | Flush | 70 | 4 | 4 | 0.7 | 30 | 650 | 1 |
| | 21 | 21 | 0° | Two layers | Flush | 40 | 1 | 1 | 2 | 30 | 650 | 1 |
| | 22 | 22 | 0° | Two layers | Flush | 40 | 5 | 3 | 3 | 30 | 650 | 1 |
| | 23 | 23 | 0° | Two layers | Flush | 20 | 1 | 1 | 2 | 30 | 650 | 1 |
| | 24 | 24 | 0° | Two layers | Flush | 20 | 6 | 3 | 3 | 30 | 650 | 1 |
| | 25 | 25 | 0° | Two layers | Protruding | 70 | 8 | 1 | 2 | 30 | 650 | 1 |
| | 26 | 26 | 0° | Two layers | Flush | 70 | 8 | 1 | 2 | 30 | 650 | 1 |
| | 27 | 27 | 45° | Two layers | Flush | 70 | 8 | 1 | 2 | 30 | 650 | 1 |
| | 28 | 28 | 80° | Two layers | Flush | 70 | 8 | 1 | 2 | 30 | 650 | 1 |
| | 29 | 29 | 90° | Two layers | Flush | 70 | 1 | | 0.7 | 30 | 650 | 1 |
| | 30 | 30 | 90° | Two layers | Flush | 70 | 2 | 3 | 0.7 | 30 | 650 | 1 |
| | 31 | 31 | 0° | Two layers | Flush | 70 | 8 | 1 | 2 | 30 | 10 | 1 |
| | 32 | 32 | 0° | Two layers | Flush | 70 | 8 | 1 | 2 | 30 | 70 | 1 |
| | 33 | 33 | 0° | Two layers | Flush | 70 | 8 | 1 | 2 | 30 | 650 | 30 |
| Comp. Ex. 1 | | 34 | No grooves | Two layers | Flush | 70 | No grooves | No grooves | No grooves | 30 | 650 | 1 |

TABLE 3

| | | Surface potential (V) NN environment | Surface potential (V) HH environment | Rate of change |
|---|---|---|---|---|
| Example | 1 | 30.2 | 27.3 | 9.6% |
| | 2 | 30.8 | 26.4 | 14.3% |
| | 3 | 30.7 | 26.7 | 13.0% |
| | 4 | 31.4 | 27.2 | 13.4% |
| | 5 | 29.6 | 23.5 | 20.6% |
| | 6 | 30.8 | 26.6 | 13.6% |
| | 7 | 29.9 | 23.6 | 21.1% |
| | 8 | 29.6 | 23.4 | 20.9% |
| | 9 | 30.3 | 26.4 | 12.9% |
| | 10 | 29.6 | 23.2 | 21.6% |
| | 11 | 29.3 | 22.9 | 21.8% |
| | 12 | 30.3 | 19.8 | 34.7% |
| | 13 | 30.2 | 24.3 | 19.5% |
| | 14 | 30.4 | 23.6 | 22.4% |
| | 15 | 29.8 | 17.7 | 40.6% |
| | 16 | 30.5 | 26.3 | 13.8% |
| | 17 | 29.1 | 22.2 | 23.7% |
| | 18 | 28.7 | 17.3 | 39.7% |
| | 19 | 29.1 | 17.1 | 41.2% |
| | 20 | 29.4 | 23.2 | 21.1% |
| | 21 | 29.6 | 22.2 | 25.0% |
| | 22 | 29.3 | 21.6 | 26.3% |
| | 23 | 29.4 | 20.6 | 29.9% |
| | 24 | 29.6 | 23.2 | 21.6% |
| | 25 | 28.2 | 22.1 | 21.6% |
| | 26 | 29.8 | 22.1 | 25.8% |
| | 27 | 29.2 | 20.6 | 29.5% |
| | 28 | 28.9 | 16.7 | 42.2% |
| | 29 | 28.6 | 17.3 | 39.5% |
| | 30 | 28.8 | 17.4 | 39.6% |
| | 31 | 29.2 | 16.3 | 44.2% |
| | 32 | 28.5 | 17.4 | 38.9% |
| | 33 | 29.4 | 20.6 | 29.9% |
| Comp. Ex. 1 | | 28.1 | 7.4 | 73.7% |

TABLE 4

| | | Toner conveyance amount ($mg/cm^2$) NN environment | Toner conveyance amount ($mg/cm^2$) HH environment | Rate of change |
|---|---|---|---|---|
| Example | 1 | 1.32 | 1.30 | 1.5% |
| | 2 | 1.34 | 1.31 | 2.2% |
| | 3 | 1.33 | 1.30 | 2.3% |
| | 4 | 1.38 | 1.36 | 1.4% |
| | 5 | 1.21 | 1.16 | 4.1% |
| | 6 | 1.32 | 1.30 | 1.5% |
| | 7 | 1.22 | 1.18 | 3.3% |
| | 8 | 1.26 | 1.22 | 3.2% |
| | 9 | 1.34 | 1.32 | 1.5% |
| | 10 | 1.24 | 1.19 | 4.0% |
| | 11 | 1.26 | 1.21 | 4.0% |
| | 12 | 1.15 | 1.08 | 6.1% |
| | 13 | 1.34 | 1.29 | 3.7% |
| | 14 | 1.33 | 1.28 | 3.8% |
| | 15 | 1.25 | 1.18 | 5.6% |
| | 16 | 1.31 | 1.29 | 1.5% |
| | 17 | 1.24 | 1.19 | 4.0% |
| | 18 | 1.21 | 1.13 | 6.6% |
| | 19 | 1.25 | 1.18 | 5.6% |
| | 20 | 1.29 | 1.25 | 3.1% |
| | 21 | 1.26 | 1.21 | 4.0% |
| | 22 | 1.23 | 1.19 | 3.3% |
| | 23 | 1.26 | 1.22 | 3.2% |
| | 24 | 1.25 | 1.21 | 3.2% |
| | 25 | 1.15 | 1.11 | 3.5% |
| | 26 | 1.28 | 1.24 | 3.1% |
| | 27 | 1.24 | 1.20 | 3.2% |
| | 28 | 1.19 | 1.13 | 5.0% |
| | 29 | 1.16 | 1.09 | 6.0% |
| | 30 | 1.17 | 1.10 | 6.0% |
| | 31 | 1.20 | 1.13 | 5.8% |
| | 32 | 1.16 | 1.09 | 6.0% |
| | 33 | 1.28 | 1.23 | 3.9% |
| Comp. Ex. 1 | | 1.01 | 0.88 | 12.9% |

The results of Examples 1 to 33 and Comparative Example 1 have revealed that the developing roller of the disclosure having a groove in an electrical insulating first region (insulating domain) causes less environmental variation, has sufficient toner conveying force in a high-temperature and high-humidity environment and is capable of forming a high-quality electrophotographic image.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-162332, filed Aug. 31, 2018, which is hereby incorporated by reference herein in its entirety.

What is claimed is:

1. A developing roller, comprising:

a substrate and an electro-conductive layer on the substrate;

an outer surface of the developing roller having an electrical insulating first region and an electro-conductive second region adjacent to the first region; and the first region having a plurality of domains independent from each other, wherein at least 50% of a total number of domains included in a square region 300 μm on each side placed on the outer surface of the developing roller have a circle equivalent diameter of 3 to 15 μm, and at least one of the domains having a circle diameter of 3 to 15 μm has a plurality of grooves.

2. The developing roller according to claim 1, wherein each of the grooves extends in a direction crossing a direction orthogonal to a circumferential direction of the developing roller with an angle.

3. The developing roller according to claim 2, wherein a narrow angle of each of the grooves with respect to the circumferential direction of the developing roller is 0 to 45°.

4. The developing roller according to claim 1, wherein a first surface of the electro-conductive layer on a side opposite to a side facing the substrate constitutes the second region.

5. The developing roller according to claim 1, wherein the electro-conductive layer retains an electrical insulating part so as to be exposed on a side of the electro-conductive layer opposite to a side facing the substrate, and an exposed portion of the electrical insulating part constitutes the first region.

6. The developing roller according to claim 1, wherein at least one of the domains having a circle equivalent diameter of 3 to 15 μm has four or more grooves.

7. The developing roller according to claim 1, wherein the grooves have an average pitch of 0.5 to 5.0 μm.

8. The developing roller according to claim 1, wherein the grooves of each of the domains having a circle equivalent diameter of 3 to 15 μm have an average depth of 0.5 to 5.0 μm.

9. The developing roller according to claim 1, wherein a percentage of an area of the domains included in the square region 300 μm on each side placed on the outer surface of the developing roller is 10 to 60%.

10. The developing roller according to claim 1, wherein a potential damping time constant defined as a time required for damping a potential of the surface to V0×(1/e) (V) is 60.0 seconds or more when a surface of the first region constituting the outer surface of the developing roller is charged to a potential Vo (V).

11. The developing roller according to claim 1, wherein a potential damping time constant defined as a time required for damping a potential of the surface to V0×(1/e) (V) is less than 6.0 seconds when a surface of the second region constituting the outer surface of the developing roller is charged to a potential Vo (V).

12. The developing roller according to claim 1, wherein the electro-conductive layer has a stacked structure of two more layers and an electro-conductive elastic layer as a first electro-conductive layer has thereon, as a component constituting a surface layer as a second electro-conductive layer, the first region having an electrical insulating surface and the second region having an electro-conductive surface.

13. The developing roller according to claim 1, wherein the first region has an uppermost surface having a height equal to or higher than a height of an uppermost surface of the second region.

14. An electrophotographic process cartridge detachably mounted on a main body of an electrophotographic image forming apparatus, comprising a developing roller;

the developing roller having a substrate and an electro-conductive layer on the substrate, an outer region of the developing roller having an electrical insulating first region and an electro-conductive second region adjacent thereto; and the first region having a plurality of domains independent from each other, wherein at least 50% of a total number of domains included in a square region 300 μm on each side placed on the outer surface of the developing roller have a circle equivalent diameter of 3 to 15 μm, and at least one of the domains having a circle diameter of 3 to 15 μm has a plurality of grooves.

15. An electrophotographic image forming apparatus, comprising an image carrier for carrying an electrostatic latent image, a charging device for primarily charging the image carrier, an exposure device for forming the electrostatic latent image on the primarily charged image carrier, a developing device for developing the electrostatic latent image with a toner to form a toner image and a transfer device for transferring the toner image to a transfer material, the developing device having a developing roller, the developing roller having a substrate and an electro-conductive layer on the substrate;

an outer surface of the developing roller having an electrical insulating first region and an electro-conductive second region adjacent thereto; and the first region having a plurality of domains independent from each other, wherein at least 50% of a total number of domains included in a square region 300 μm on each side placed on the outer surface of the developing roller have a circle equivalent diameter of 3 to 15 μm, and at least one of the domains having a circle diameter of 3 to 15 μm has a plurality of grooves.

* * * * *